US005836841A

United States Patent [19]

Fell

[11] Patent Number: 5,836,841

[45] Date of Patent: Nov. 17, 1998

[54] HOCKEY STICK BLADE WITH CONTROL FASCIA AND REPLACEABLE CONTROL FASCIA FOR USE THEREWITH

[76] Inventor: Barry M. Fell, 7124 Red Top Rd., Hummelstown, Pa. 17036

[21] Appl. No.: 661,620

[22] Filed: Jun. 11, 1996

[51] Int. Cl.[6] ..... A63B 59/14

[52] U.S. Cl. ..... 473/563

[58] Field of Search ..... 473/563, 560, 473/561, 189

[56] References Cited

U.S. PATENT DOCUMENTS

| | | | |
|---|---|---|---|
| 2,912,245 | 11/1959 | Gardner et al. | 473/563 |
| 3,561,760 | 2/1971 | Klay | 473/563 |
| 5,558,326 | 9/1996 | Adamson et al. | 473/563 |

FOREIGN PATENT DOCUMENTS

| | | | |
|---|---|---|---|
| 984420 | 2/1976 | Canada | 473/189 |
| 1043379 | 11/1978 | Canada | 473/189 |
| 53-38430 | 8/1978 | Japan | 473/189 |
| 547946 | 9/1942 | United Kingdom | 473/189 |

OTHER PUBLICATIONS

Ramrod, "The Sporting Goods Dealer", pp. 49 & 146, Dec. 1972.

Five Pages of Advertisements from "Stick It Hockey Tape", Hockey Tech, LLC.

*Primary Examiner*—Mark S. Graham

*Attorney, Agent, or Firm*—Brooks & Kushman P.C

[57] ABSTRACT

The subject invention pertains to a control fascia adapted to be attached to one side of the blade of an ice hockey or street hockey stick. Ridges having a vertical component extending above the control fascia surface enable improved puck or ball control while offering freedom from unraveling, and minimum weight. The control fascias can be easily manufactured at low cost and are suitable for bearing logos or advertisements.

1 Claim, 7 Drawing Sheets

Fig. 5a
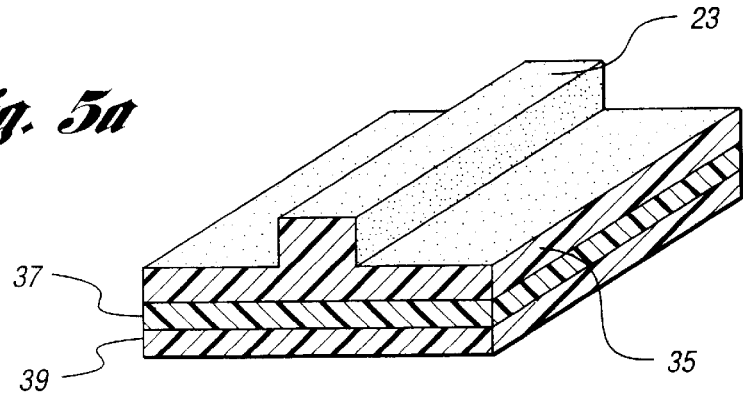
Fig. 5b
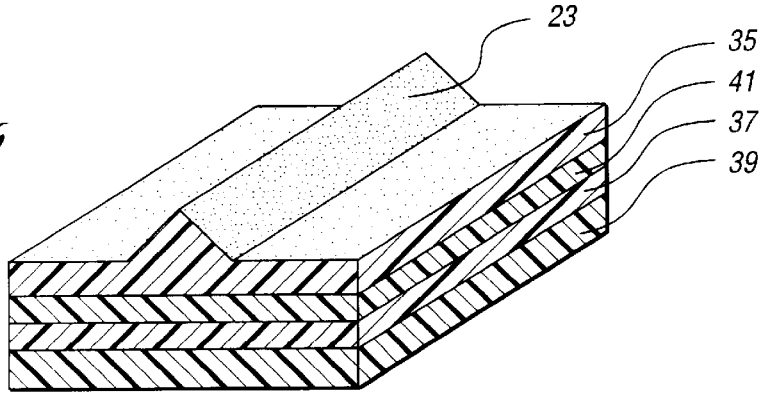
Fig. 5c
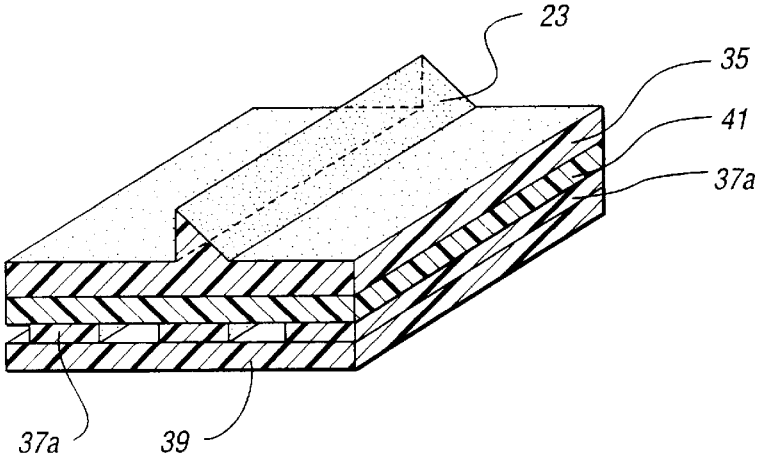
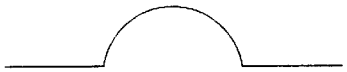
Fig. 5b-1
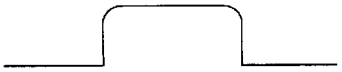
Fig. 5b-2
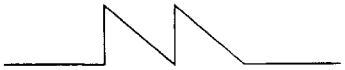
Fig. 5b-3

HOCKEY STICK BLADE WITH CONTROL FASCIA AND REPLACEABLE CONTROL FASCIA FOR USE THEREWITH

TECHNICAL FIELD

The present invention pertains to hockey. More particularly, the present invention pertains to a control fascia which may be molded onto the blade of a hockey stick, and particularly to a replaceable control fascia for adhesive attachment to the blades of ice hockey and street hockey sticks which permit improved puck and ball handling, respectively.

BACKGROUND ART

Ice hockey is an important participation and spectator sport world wide; and is played at many levels, for example professional, olympic, semi-professional, college, and high school, as well as league play at all age levels. Street hockey is a relatively recent outgrowth of the interest in ice hockey. Unlike ice. hockey, street hockey does not need an ice arena, but may be played on virtually any hard, smooth surface, generally with in-line skates (roller blades) rather than ice skates. Both ice hockey and street hockey require accurate control over a scoring piece, a puck in ice hockey, and a puck or ball in street hockey.

The object in both sports is to direct the scoring piece into a goal, which may comprise a net-like. structure. Directing the scoring piece by hitting it. with the stick necessitates that the player have control over the scoring piece and its interaction with the blade of the stick. In addition, as ice hockey and street hockey are team sports, the player must also be able to pass the scoring piece to his teammates, as well as being able to "stick handle" the scoring piece down the ice or other surface.

The blades of hockey sticks are generally smooth and often somewhat curved, and a hard shot or long pass may often start near the heel of the blade, but leave the blade near its toe. If the blade is smooth, the puck is difficult to control. For many years, ice hockey players at all levels have wrapped adhesive tape around the stick in an effort to improve puck handling, and this practice has spread to street hockey as well. However, the use of tape has numerous disadvantages. First, the complete wrapping of the blade adds considerable weight to the blade. The tape on the top and bottom of the blade does not affect ball or puck control, and the tape along the bottom of the blade, particularly in street hockey, interferes with the smooth progress of the blade across the playing surface.

Second, the tape easily becomes abraded and torn, and as a result, unravels. This necessitates retaping at frequent intervals, many times as often as once per period. Third, although puck handling capability of a taped stick is superior to the use of a bare stick, it is only marginally improved when using a puck, and significantly impaired when using a ball. Fourth, not being waterproof, the tape does not protect against contact of the bottom of the blade with moisture. Finally, the tape wraps obscure any logos or advertisements imprinted upon the blade. Tape itself cannot be used to present significantly sized logos or advertisements, since it has a narrow width to permit its wrapping around the complex contours of the modern hockey blade.

It would be desirable to provide a renewable, more durable blade surface which does not involve wrapping with tape, which is durable and of light weight, which improves puck and ball handling as compared to tape, and which is capable of performing the useful commercial activity of displaying logos, advertisements, and the like. It would be further desirable to provide a hockey stick with a control fascia molded onto the blade or adhesively attached to the blade at the point of hockey stick manufacture.

SUMMARY OF THE INVENTION

It has now been surprisingly discovered that control fascias having a certain level of granularity provide for greatly improved control of scoring pieces in ice and street hockey. The control fascias are durable, easily replaceable, and unlike tape, may be manufactured with displayable logos. The control fascias may also be designed to be integral with the blade of the hockey stick.

BRIEF DESCRIPTION OF THE DRAWINGS

FIG. 3*d*' illustrates measurement of valley width in a diamond-shaped fascia pattern;

FIG. 5*a* illustrates a cross-section of a fascia composition showing the ribs of a raised pattern of a control fascia;

FIG. 5*b* illustrates a further embodiment of a replaceable control fascia illustrating its construction;

FIG. 5*c* illustrates a yet further embodiment of a replaceable control fascia illustrating its construction;

FIGS. 5*d*-1 to 5*d*-3 illustrate additional ridge shapes in cross-section;

DESCRIPTION OF THE PREFERRED EMBODIMENTS

Figure 1A:
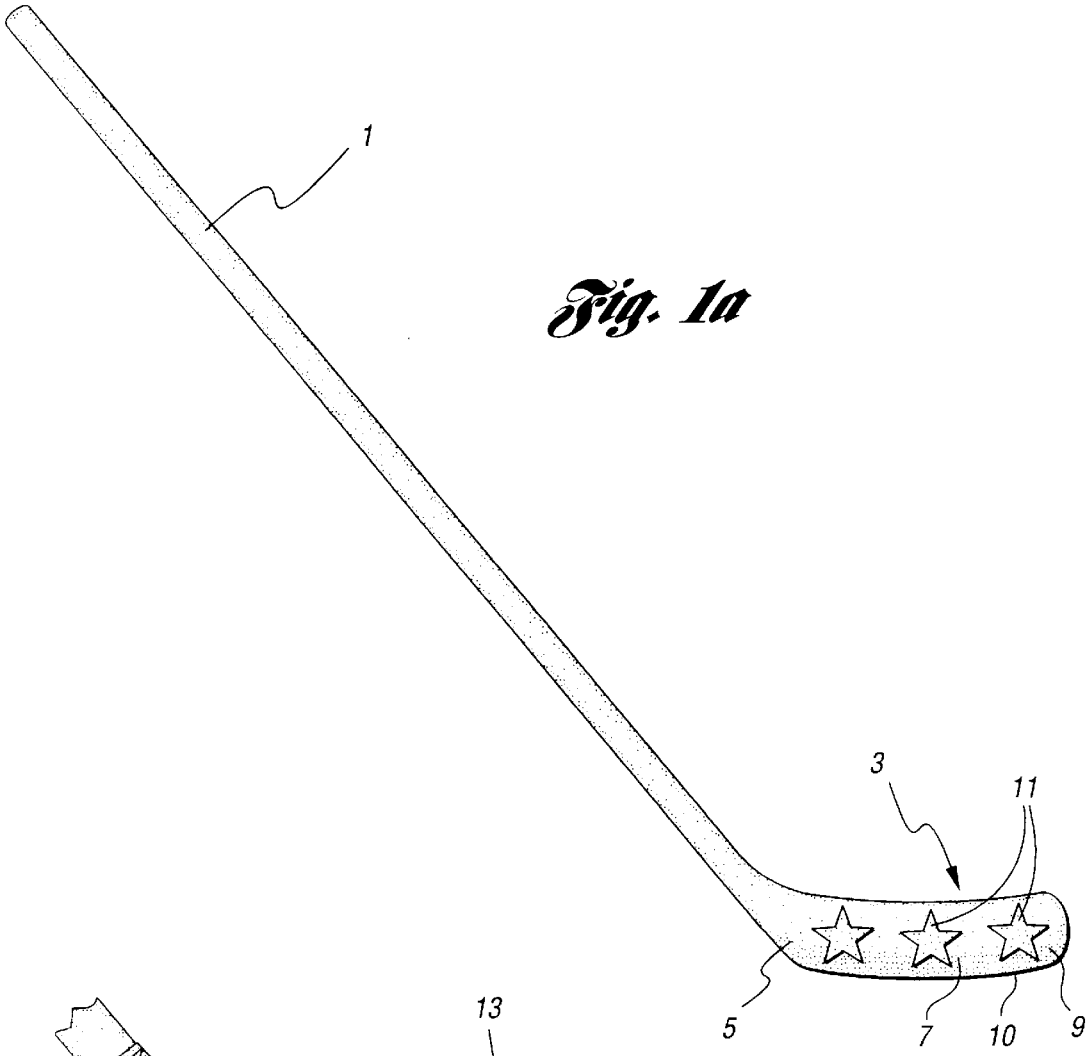
FIG. 1*a* illustrates a hockey stick blade with no wrap, showing a three star logo.

The replaceable control fascias of the present invention comprise a flat sheet-like material with an exterior portion having a series of "ridges" and "valleys," when viewed from a section in one direction. It is believed that the ridges temporarily "catch" or impede the progress of the puck or ball both along the blade as well as up and down the blade, thus providing for increased control. However, it has been rather surprisingly found that the relationship between the width of the "valley" and the height of the "ridges," herein termed the "granularity" of the fascia, is critical in enabling good control of the playing piece (puck or ball). The minimum and maximum heights of the ridges is important as well. In particular, it has been. found that whatever the pattern, the height of the ridges of the control fascia pattern must be minimally 0.010 in (0.025 cm) and maximally 0.075 in (0.19 cm), preferably 0.015 in (0.038 cm) to 0.060 in (0.15 cm) However, for maximum scoring piece control, it has been found that a closer repeating pattern of ridges requires a lower ridge height than a more distantly spaced pattern. The optimum relationship between ridge height, $H_r$, average valley width $V_{av}$ for maximum control may be given by the formula:

$$0.03<H_r/V_{av}<0.2$$

This formula applies to the portion of the control fascia which lies between the bottom of the face of the blade to approximately 0.65 of the height above the bottom of this face, and to the midsection, preferably the length between toe and heel, calculated at the top of the ridges rather than the base of the ridges. More preferably, $H_r/V_{av}$ lies between 0.04 and 0.15. However, it would not depart from the spirit of the invention to cover only a portion of the blade rather than its entire face with a control fascia, or to remove ridges or other control surfaces from along the extreme bottom edge, from the topmost one third or so, or from the extreme heel or toe of the blade, all portions of the blade where blade to scoring piece contact is expected to be minimal. Likewise, the ridges may be interrupted by non-ridged sections without departing from the spirit of the invention. For example, a continuous series of raised "dots" and/or "dashes" may be used. It is preferable that when non-continuous ridges are used, that the "ridge" portion constitute at least 50%, preferably 70% or more, and more preferably 90% or more of the total length of the ridge calculated assuming the total length is continuous. Preferably, the ridge is substantially or fully continuous.

It has further been found that the ridges of the control fascia must have a significant vertical component as well as a minimal spacing. The vertical component is necessary to provide control over this scoring piece. Experimental fascias with only horizontal ridges showed no improvement over standard stick wrapping tape. The vertical component may be in the form of spaced, parallel, vertical ridges, "criss-crossed" overlapping angular ridges, or may be formed as circular or other patterns, either overlapping, opposed, or parallel, as more fully described hereinafter. The ridges, in section orthogonal to their length, are preferably wider at their base, i.e., in the plane of the non-ridged fascia material, than their peak.

The ridges of the control fascia must be separated by valleys which must not only satisfy the ridge height/valley width relationship, but which moreover should have a certain width. The width of the valley $V_{av}$ must be on the average, between 0.10 inch (0.25 cm) and 1.0 inch (2.5 cm), preferably between 0.20 inch (0.51 cm) and 0.75 inch (1.9 cm), and most preferably from about 0.25 inch (0.64 cm) to about 0.50 inch (1.27 cm). $V_{av}$ is measured across the length of the face of blade and parallel to the blade bottom surface, and is the average of the spacings. For non-uniform spacing of ridges, for example where the vertical ridges along the middle portion of the blade are 0.40 inches (1.0 cm) apart, but ridges near the heel or toe of the blade are much closer, e.g. 0.05 inches (0.13 cm), the latter are ignored when calculating the average ridge spacing and hence valley width $V_{av}$. Examples of calculations are given hereafter.

Thus, the valley width $V_{av}$, determined by the ridge spacing, should be such that the most active portions of the playing surface display the granularity expressed previously. It would not depart from the spirit of the invention, for example, to include one or a small number of very wide valleys near the center of the stick surrounded by ridges in accordance with the ranges given previously, and/or a number of closely spaced ridges either at the center or at the ends. In calculating the average valley width, spacings considerably large but few in number and spacings very small but numerous should be discounted when measuring the average.

Figure 6A:
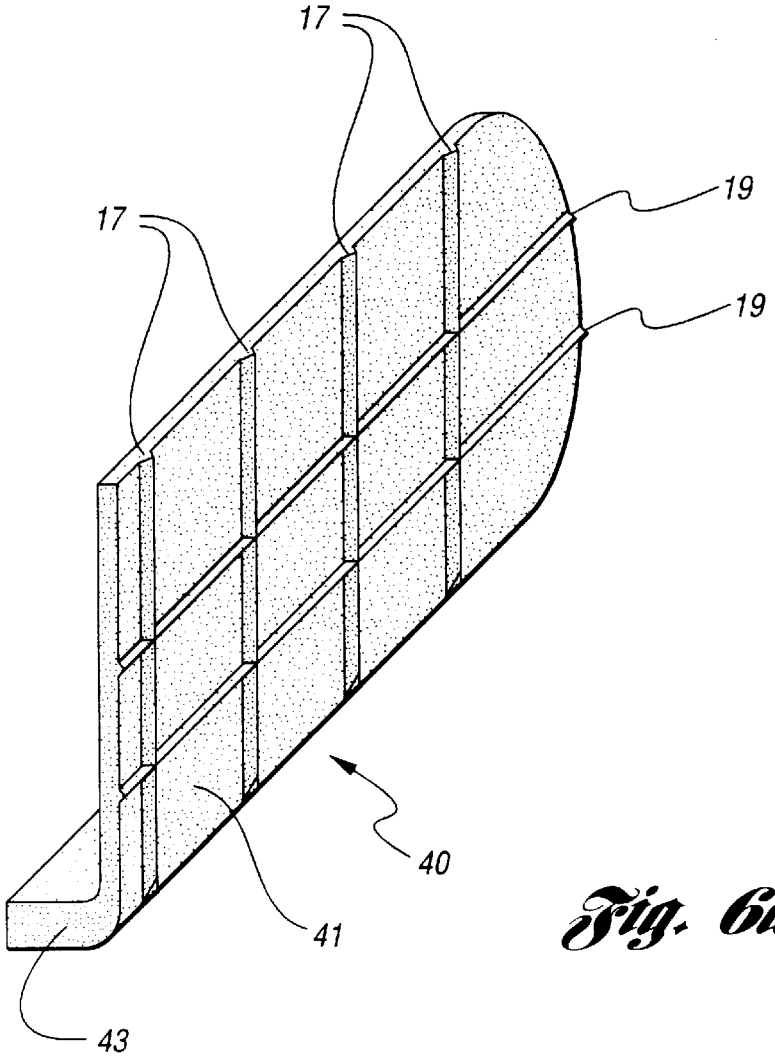
FIG. 6*a* illustrates a perspective view of one embodiment of fascia construction showing an integral molded protective lip.

A further, significant advantage of the control fascias of the present invention is that as they are substantially planar and do not require wrapping around the blade, they may themselves perform additional functions not possible with tape, or may allow such functions to be performed. For example, adhesive tape is of virtually no help in preventing ingress of moisture from the ice or from a wet playing surface into the bottom edge of the blade of a wooden stick. The tape itself readily absorbs moisture. The planar nature of the adhesively applyable control fascias of the present invention allow the control fascias to be manufactured with a lip which can be adhered to the bottom of the blade. Alternatively, the fascia material may be bent over the edge of the blade face to cover the exposed edge. These constructions provide for a stick where the blade edge is substantially protected against water penetration. A control fascia having a molded lip extending at a sharp angle, i.e. a right angle from the bottom edge of the fascia is still substantially planar as that term is used herein. It should be noted that slightly curved control fascias, for example those which are of more rigid plastic which are designed for application to curved blades, are also substantially planar as that term is used herein. FIG. 6*a* illustrates a control fascia 40 having a molded lip 43. Vertical ribs 17 and horizontal ribs 19 are elevated from the essentially planar surface 41 of the control fascia, whereas the lip 43 extends rearward away from the face, and will cover all or a substantial portion of the bottom surface of the blade.

Rather than the control fascia per se being used as a means of preventing moisture penetration into the blade, application of the control fascia to the blade face allows the separate application of a water barrier to the blade bottom.

A further useful feature of the subject fascias is the option of employing a friction-reducing and/or wear-resistant blade edge piece. In the case of control fascias of hard, low friction thermoplastics, a wrap-around or molded edge, previously described as useful in preventing water absorption by the blade, may also be useful in providing a low friction and/or wear-resistant surface on the blade bottom edge. Such a wear-resistant surface may be generally useful, but is particularly useful in street hockey where the playing surface usually is relatively rough. Low friction materials are also particularly useful for play on smooth, artificial surfaces such as "SportCourt," or painted wood. For ice hockey control fascias, it is desirable that a somewhat softer, elastomeric material may be used. Such materials cannot, in general, provide a low friction edge.

By the terms "hard" and "low friction," is meant a relatively hard thermoset or thermoplastic such as, but not limited to, polytetrafluoroethylene, other halogenated thermoplastics, polyurethanes with hardnesses on the higher Shore D scale, polypropylene, polyethylene, polyacrylates, polyethersulfones, polysulfones, polyether ketones, other polyarylene ethers, polyarylene sulfides, SURLYN®, polyetherimides, cured epoxy resins, and the like. Not included within this definition are thermoplastics or thermosets usually viewed as elastomeric, for example polyurethane elastomers with hardness on the low Shore D scale or on the Shore A scale, natural or synthetic rubber, Hytrel® elastomer, etc.

The subject invention fascias, particularly those for street hockey, are unique in allowing use of a low friction lower blade edge, either applied as part of the control fascia or as a separate blade edge. Such low friction surfaces cannot be used with tape wraps for obvious reasons, and tape itself is virtually never used in street hockey due to the increased friction offered against the playing surface and the short life of such wraps due to abrasion by the playing surface.

The invention may now be more fully described in relation to the drawings, which are illustrative of certain selected embodiments only, and should not be construed as limiting the scope of the claims in any way.

Figure 1B:
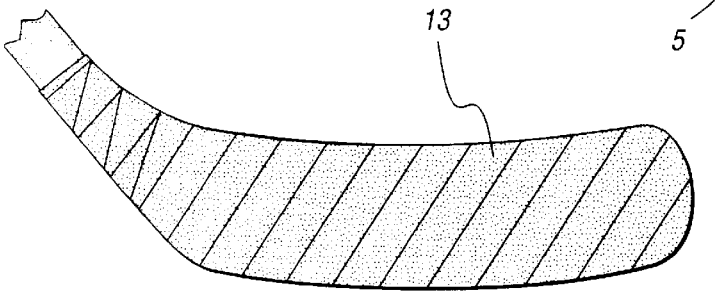
FIG. 1*b* illustrates the hockey stick blade of FIG. 1*a* with a tape wrap, showing obscuring of the blade logo.

FIG. 1*a* illustrates a typical ice hockey stick. At 1 is the shaft, or handle of the stick, and at 3, the blade, which has a heel portion 5, a central portion 7, and a toe portion 9. At 10 is the bottom surface, which may be used as a reference line extending in a direction from heel to toe. At 11 is a logo which consists of three stats, imprinted or painted on the blade. While FIG. 1*a* represents an ice hockey stick, this type of stick is also used by serious street hockey players, as the blade is a laminated, rather than a flexible blade. The greater stiffness of the laminated blade offers improved control. FIG. 1*b* illustrates a typical tape wrap on a stick of FIG. 1*a*. The tape 13 is wrapped around the blade from the handle just beyond the heel of the blade to the toe of the blade. Note that the tape completely obscures the three star logo on the blade.

Figure 1C:
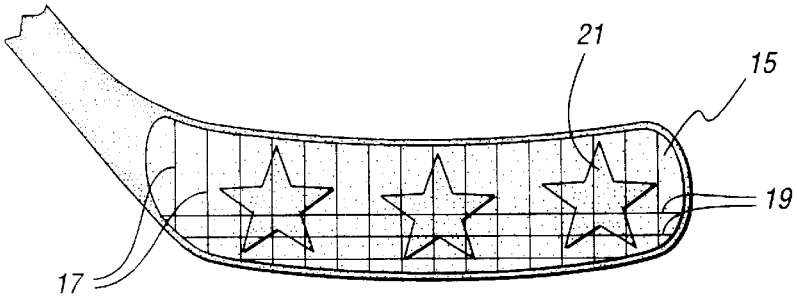
FIG. 1*c* illustrates the hockey stick of FIG. 1*a* with a replaceable control fascia of the subject invention displaying a three star logo printed on the fascia itself.

FIG. 1*c* illustrates the use of a replaceable control fascia 15 of the subject invention with the hockey stick of FIG. 1*a*. Note the vertical ridges 17 which define the valley width $V_{av}$. In this case, all the vertical ridges are evenly spaced and of equal height. Horizontal ridges 19 also serve to enhance control, particularly in street hockey played with a ball, as the horizontal ridges help prevent the puck or ball from climbing up the face of the stick.

It has been found that the horizontal ridges 19 should also have a minimal spacing. If too closely spaced, a street hockey ball will tend to slide rather than roll. When this occurs, the blade will more easily rise up over the ball, thus losing control. Preferably, the vertical spacing of the horizontal ridges follows the same preferred spacings as the vertical ridges. Note that the horizontal ridges 19 are only needed at the lower portion of the blade, although they may of course be extended to the top. of the blade as well. Note that the control fascia may have a logo 21 incorporated, either as part of a molded face layer of the fascia or as a backing or "support" material. The fascia molded face, support layer or adhesive layer, in addition to being optionally printed, may be colored, either transparent, translucent, or opaque, depending upon the effect desired.

Figure 2A:
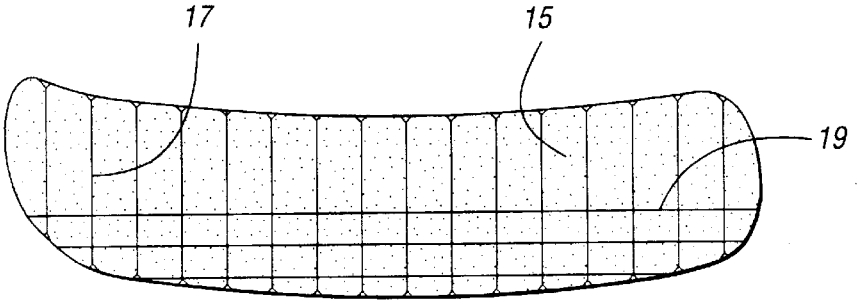
FIG. 2*a* illustrates one pattern of granularity of a replaceable control fascia which provides improved scoring piece control.

The arrangement of vertical and horizontal ridges of he fascia of FIG. 1*c* is illustrated more clearly in FIG. 2*a*. The vertical ridges 17 and horizontal ridges 19, where present, are all of uniform spacing. The ridge height $H_r$ is uniform at 0.065 inch (0.165 cm), the average vertical valley width $V_{av}$ is 0.5 inch (1.27 cm), and the horizontal ridge spacing 0.25 inch (0.64 cm).

Figure 2B:
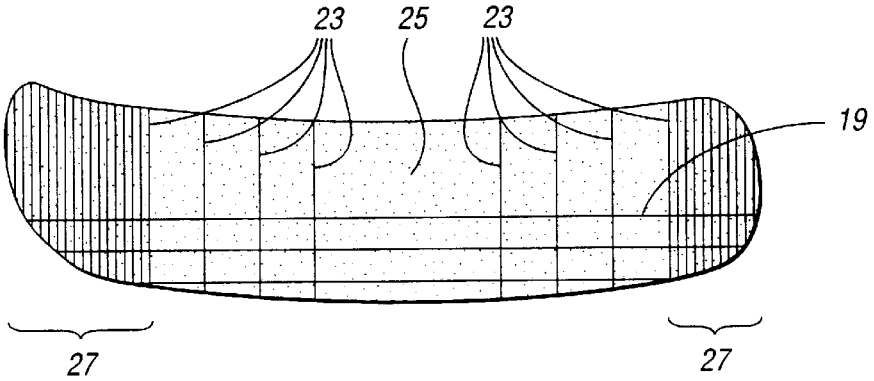
FIG. 2*b* illustrates a further pattern of granularity of a replaceable control fascia which provides improved scoring piece control.

FIG. 2*b* illustrates a further control fascia. In FIG. 2*b*, the vertical ridges are not evenly spaced, those centrally located, 23, flanking an unusually large valley 25, while those 27 being remote from the central portion of the blade are very closely spaced. In the case of FIG. 2, the central, wide valley 25 and the valleys between closely spaced ridges 27 are ignored in calculating the average ridge width, $V_{av}$. Thus, if the spacings between adjacent ridges 23 are 0.40 inch (1.0 cm), then the $V_{av}$ will be 0.40 inch (1.0 cm).

Figure 2C:
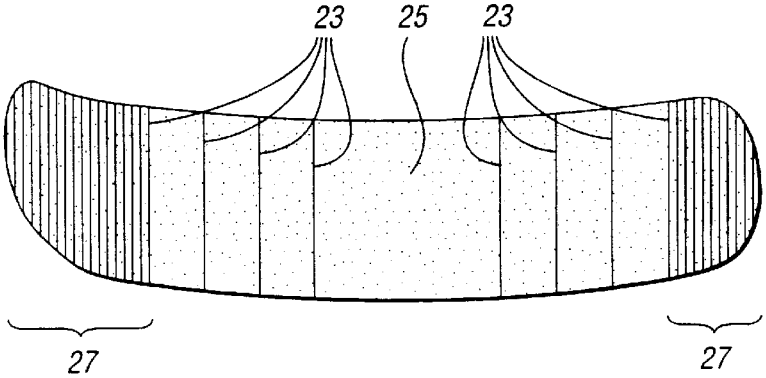
FIG. 2*c* illustrates another pattern of granularity of a replaceable control fascia which provides improved scoring piece control.

FIG. 2*c* illustrates a further embodiment of a control fascia. In the case of FIG. 2*c*, ridges 23 having variable spacing flank large central valley 25. Toward the heel and toe of the blade, the ridges are quite close together. In measuring the average ridge width, valleys having widths more than 4 times the median width and less than 0.1 times the median width, for example, may be ignored. In calculating the average width of FIG. 2*c*, for example, the central valley 25 will be ignored, and the valley widths between the first six lines 23 on either side of central valley 25 will be included. The fascia of FIG. 2*c* has no horizontal ridges and is a less preferred embodiment.

Figure 2D:
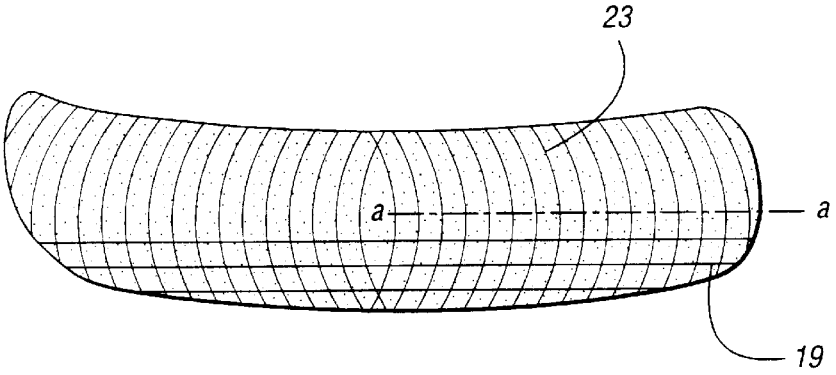
FIG. 2*d* illustrates another pattern of granularity of a replaceable control fascia which provides improved scoring piece control.

FIG. 2*d* is an opposing circular pattern in which each ridge 23 has both a horizontal and a vertical component. As the ridge spacing is uniform and symmetrical, the average ridge width may be measured by the horizontal distance between ridges, for example along line a—a. Note the horizontal ridges 19.

Figure 3A:
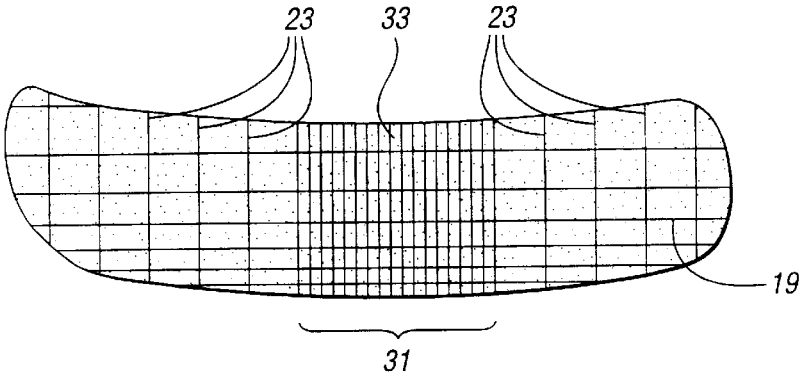
FIG. 3*a* illustrates another pattern of granularity of a replaceable control fascia which provides improved scoring piece control.

FIG. 3*a* illustrates a control fascia having uniform vertical ridges 23 flanking a central portion 33 having closely spaced ridges 31. In this case, the average ridge width is determined from the valleys between ridges 23. Note that horizontal ridges 19 extend up the entire face of the blade.

Figure 3B:
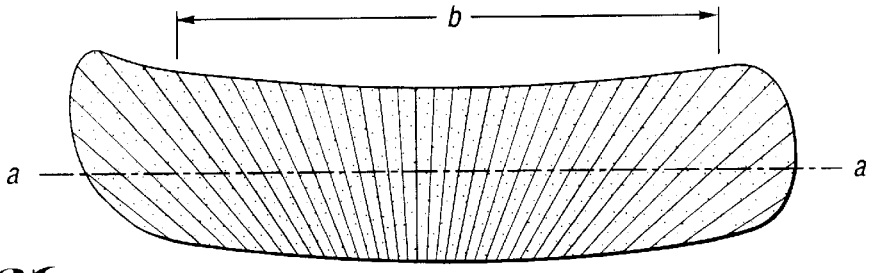
FIG. 3*b* illustrates another pattern of granularity of a replaceable control fascia which provides improved scoring piece control.
Figure 3C:
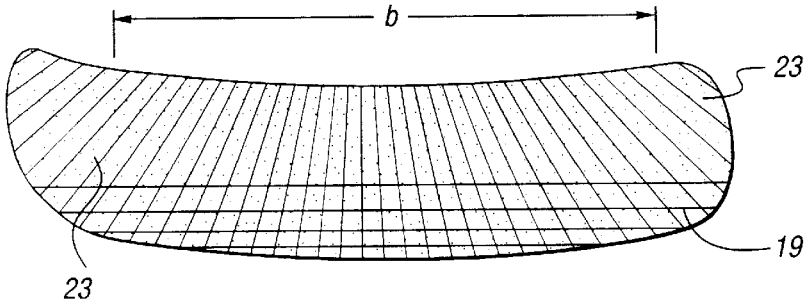
FIG. 3*c* illustrates another pattern of granularity of a replaceable control fascia which provides improved scoring piece control.

FIGS. 3*b* and 3*c* illustrate sunburst and reverse sunburst patterns, respectively, where each line has both a horizontal and vertical component. In both FIGS, the average ridge width is the average ridge to ridge spacing over the central three-fourths of the blade, dimension "b", measured along a line approximately centered top to bottom on the blade, a—a. FIG. 3*c* has horizontal ridges 19 in addition to the sunburst pattern.

Figure 3D:
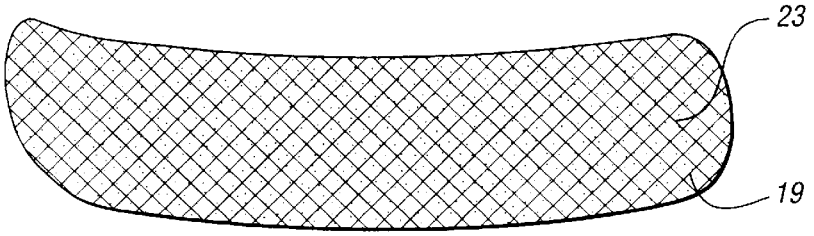
FIG. 3*d* illustrates another pattern of granularity of a replaceable control fascia which provides improved scoring piece control.
Figure 3D:
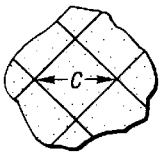

FIG. 3*d* illustrates a diamond-shaped ridge pattern where the vertical ridges and horizontal ridges are identical and at 45° angle to the blade bottom surface. The average ridge spacing is one-half each square's diagonal, dimension "c" in FIG. 3*d*'.

Figure 4A:
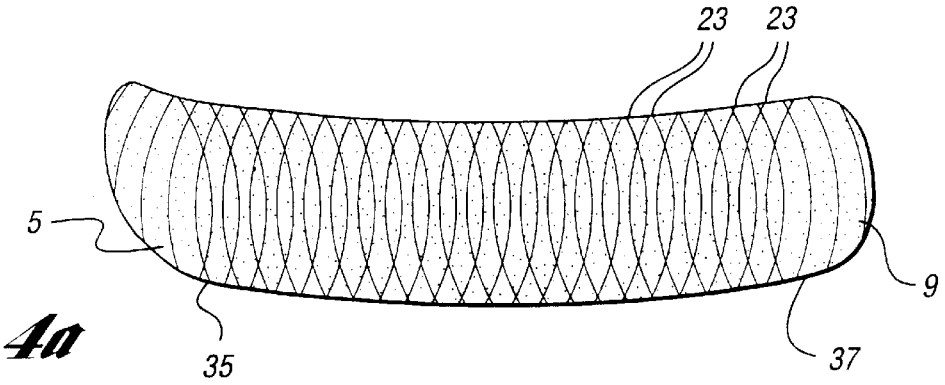
FIG. 4*a* illustrates another pattern of granularity of a replaceable control fascia which provides improved scoring piece control.

FIG. 4*a* illustrates an overlapping circle pattern where the centers of the opposing circles are located on a line parallel to the blade bottom and approximately half its height. At the heel 5 and toe 9 ends of the fascia, the opposing circular component has been eliminated for clarity. In this case, the average ridge width is defined as one-half the circular offset, i.e., one-half the radial space between ridges 23,23.

Figure 4B:
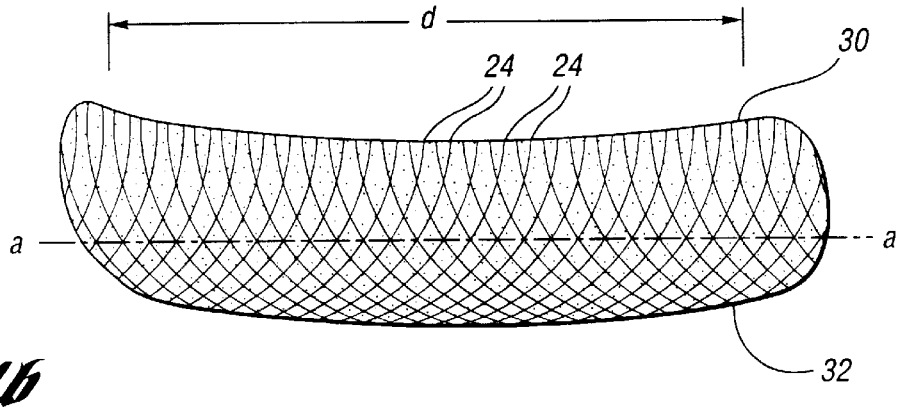
FIG. 4*b* illustrates another pattern of granularity of a replaceable control fascia which provides improved scoring piece control.

FIG. 4*b* illustrates a control fascia pattern where intersecting circular ridges are provided as in FIG. 4*a*, however, the centers of the circles are not coincident with the midpoint of the blade, but rather are located along a line d—d displaced from the blade. The ridges will thus have non-uniform spacing from top to bottom. The average ridge width may be measured as the distance between adjacent, "parallel" ridges 24,24 along line a—a or may be calculated as the average of the spacing between adjacent, "parallel" ridges 24,24 across the top edge 30 and bottom edge 32.

Figure 4C:
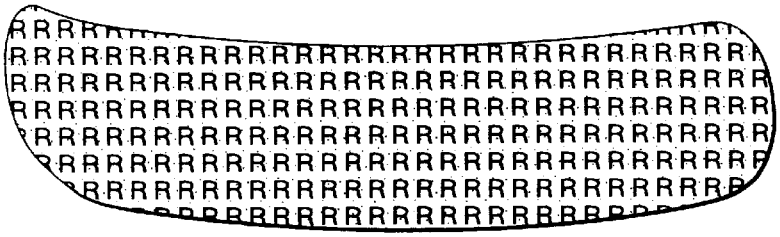
FIG. 4*c* illustrates a yet further pattern of granularity of a replaceable control fascia which provides improved scoring piece control.

FIG. 4*c* illustrates a control fascia where the vertical and horizontal ridges are comprised of miniature logos, in this case, miniature letters "R." The logos are spaced apart in patterns which would correspond to a geometric pattern such as, but not limited, to those disclosed in FIGS. 2*a* to 4*b*. The average ridge width is calculated from the midpoint of one "line" of logos to the adjacent "line" as was illustrated in the previous Figures.

The cross-section of the ridges or "ribs" of the patterns of the control fascias may take a number of forms, as shown in FIGS. 51*a*–51*d*. In FIG. 5*a*, for example, the ridge 23 is rectangular in cross-section and extends above the remainder of the fascia face material 35. At 37 is shown an adhesive layer used to adhere the fascia to the face of the blade, and at 39 is shown a release film which prevents the adhesive layer from sticking to its surroundings until it is desired to attach it to the blade.

In FIG. 5*b* is illustrated a ridge 23 of triangular cross-section extending above the remainder of fascia face material 35. Located below face material 35 is support 41, which may, for example, be a plastic film, i.e., MYLAR® polyester, a woven or non-woven fabric, e.g. polyester scrim, metal foil, or other support, which may optionally be imprinted with a logo, when face material 35 is transparent or translucent. Below support 41 is adhesive film 37 and superficial to the adhesive film is a sheet of release paper 39. The term "release film" includes release paper and like products.

In FIG. 5*c*, a "saw tooth" ridge is illustrated, the construction otherwise being similar to FIG. 5*b*. In FIG. 5*c*, however, the adhesive is applied in strips 37*a* rather than an entire sheet, to facilitate removal from the blade for replacement. Adhesive may also be applied in a grid, as isolated "dots", or in other arrangements.

Figure 6B:
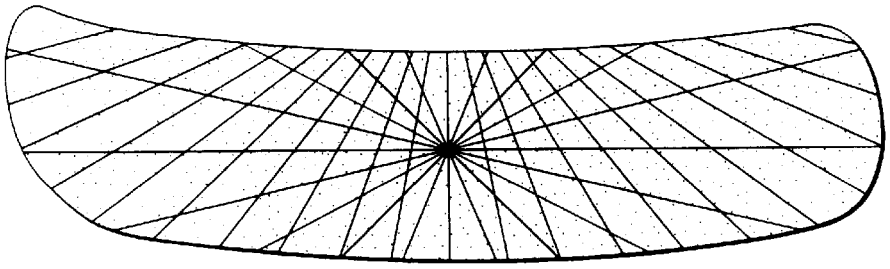
FIG. 6*b* illustrates a further control fascia pattern.

FIG. 5*d* illustrates several additional ridge shapes in cross-section. Ridges with sharp corners, i.e., those illustrated in FIGS. 5*a*–5*c* are preferred. FIG. 5*d*-1 illustrates a circular cross-section, 5*d*-2 a rectangular section with rounded edges, and 5*d*-3 a double tooth cross-section. Saw tooth shaped ridges may be used to give preferential control of the puck or ball in one direction of travel over the blade versus another direction. FIGS. 6*a* and 6*b* have been previously described.

Figure 7A:
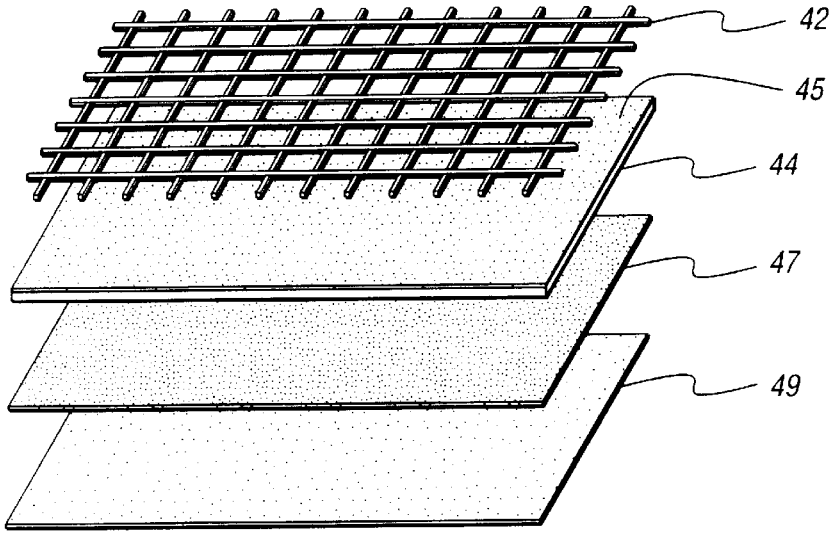
FIG. 7*a* illustrates an exploded view of one embodiment of control fascia construction.

FIG. 7*a* illustrates one construction of control fascia, in exploded view. Plastic, textile, or metal mesh 42 is bonded to a thin film 44 coated on its surface with a thermoset or high melt temperature thermoplastic adhesive 45 under sufficient heat and pressure to form a strong bond. Film 44 is preferably as thin as possible to minimize weight; its major function is to isolate pressure sensitive or lower melting thermoplastic adhesive 47 from the playing surface. Film 47, preferably removably adhered to release film 49, is bonded to film 44. In use, the fascia is supplied in a rectangle to be cut to shape by the user or as a pre-cut fascia, the release film 49 removed, and the fascia adhered to the blade by pressure, or optionally, with the aid of heat.

Figure 7B:
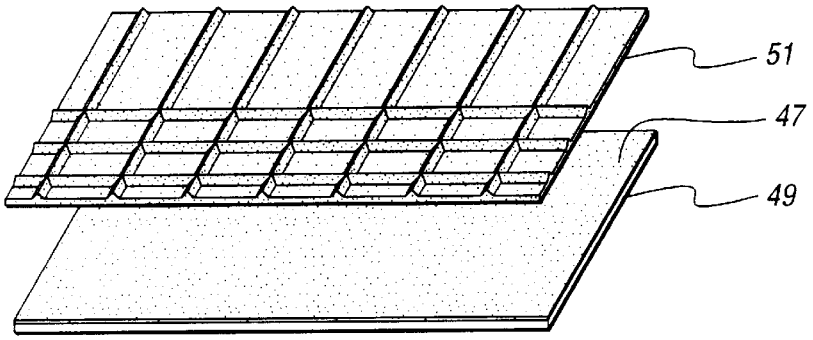
FIG. 7*b* illustrates an exploded view of a further embodiment of control fascia construction.
Figure 7C:
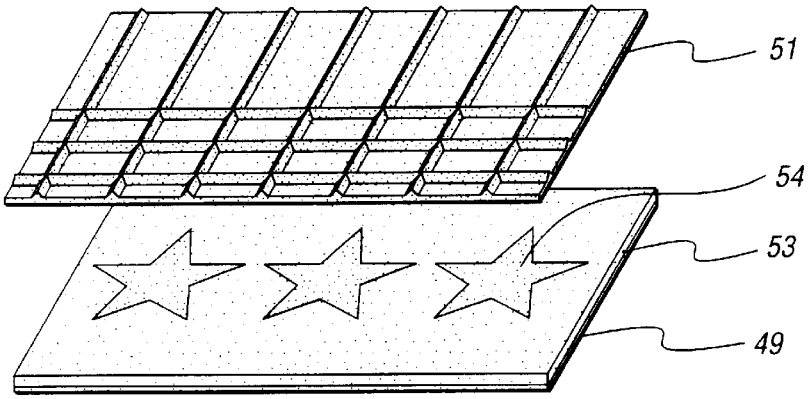
FIG. 7*c* yet further illustrates an exploded view of a further embodiment of control fascia construction.

FIG. 7*b* illustrates a preferred embodiment of the subject invention. In FIG. 6*b*, molded fascia 51 is applied to pressure sensitive film 47 attached to release film 49. FIG. 7*c* illustrates a similar arrangement, except that textile support scrim 53 has been previously printed with a logo 54 and then impregnated or coated with pressure sensitive adhesive. Release film 49 protects the assembly from premature adhesion.

The playing piece contacting face of the fascia material may be selected from materials of varied hardnesses. Preferably, the material is resilient, in the sense that an impact will compress or distort the material followed by a substantial recovery of original dimension. For ice hockey, the fascia material may advantageously be an elastomer with a hardness of from about 40 Shore A to 90 Shore D. It may also be a thermosetting plastic or thermoplastic, or an impregnated mesh-type textile material. Preferably, however, the fascia material for an ice hockey fascia is a thermoplastic elastomer such as, but not limited to, polyurethane. Thermoplastic polyurethane may be obtained in numerous degrees of hardness, and may be molded in a heated press using a reverse engraved tool, or continuously using heated, embossed or engraved rollers. The film may be printed with a logo on either the interior or exterior surface prior to embossing or molding, and custom patterns are easily made by CNC machining of the appropriate tools or cylinders. The film thickness is advantageously between 0.002 inch (0.005 cm) and 0.020 inch (0.05 cm), but thicker and thinner materials may be used as well. A preferred polyurethane fascia material is TP Urethane™ thermoplastic polyurethane film of 0.005 inch (0.0127 cm) to 0.012 inch (0.030 cm) thickness, available from J. P. Stevens Elastomerics. Open weave mesh or lace fabrics or other similar products, i.e. metal or plastic mesh may be used as well.

For street hockey, particularly street hockey played with a ball scoring piece, the fascia advantageously has a low coefficient of friction relative to the playing surface so that the blade allows the ball to freely roll or slide against it in the vertical direction. If the frictional engagement of the ball with the blade is too high, then the blade will tend to "climb" over the ball when stick handling the ball. However, in the heel to toe direction, the ball must be controlled in order to improve passing and shooting accuracy. Because of these needs, ball players have typically used a bare, untaped blade, as the taping increases the coefficient of friction and decreases stick handling ability. By supplying a blade with control ribs having a vertical component, the heel to toe control is increased, while providing a relatively hard material for the fascia lowers the coefficient of friction so as to increase stick handling and help prevent the blade from climbing over the ball. For street hockey, therefore, the fascia material may be advantageously selected from thermoplastic and thermosetting resins which are relatively hard. Exemplary resins include SURLYN™ and polypropylene. The latter is available as a 0.005 inch (0.012 cm) to 0.012 inch (0.030 cm) thick film from Solvay Industrial Films.

The adhesive used to mount the fascia to the blade may be applied separately, e.g. as a spray adhesive, but is preferably integral with the control fascia. The control fascia may have adhesive sprayed on, laminated to, or printed on its inner (to the blade) surface, and then covered with a release film. Preferably, an integral adhesive/release film will be pressed onto the reverse side of the fascia material, also through a continuous process, e.g. by passing the fascia and film adhesive/release sheet between pressure rollers.

The adhesive used to adhere the assembly to the blade may be a thermoset adhesive, or a hot melt adhesive, to be applied, e.g. with a hot iron or hot air gun, but is most preferably a removable pressure sensitive adhesive. A suitable pressure sensitive adhesive is a PSA adhesive known as Product 1000 available from SWK Adhesives as a film coated on a Kraft paper release film.

Suitable textile scrim (support) material is Reemay Style 2014 available from BRA Non-Wovens. It is desirable to keep the weight of any scrim material to as low a figure as possible, in order to keep the weight of the control fascia as low as possible. The scrim may be imprinted with a logo, for example by transfer printing, sublimation printing, rotogravure, or other printing methods.

The control fascias of the subject invention have been found to perform much better than the tape commonly used for hockey blades, even embossed tapes such as those known as "Player Tape" available from Stick It Hockey Tape, Hockey Tech, LLC. The latter contains impressions designed to match those of the sides of hockey pucks. In practice, however, the purported "match" depends upon wrapping at the correct angle, and little or no improvement over conventional tape is seen. The impressions, of course, have no match, even in theory, when street hockey balls are used. Likewise, the same company produces a "Goalies Tape" having numerous closely spaced horizontal lines, but no vertical ridges. The vertical ridges or other ridges having a vertical component are necessary to be able to offer improved control of pucks and balls.

The control fascias of the subject invention are relatively durable, enough such that they may also be applied to the blade of the hockey stick with a thermoset adhesive. Such adhesives may be supplied as a film sandwiched between a molded fascia and a release film, as illustrated in FIG. 7*b*, or in other forms. If supplied as in FIG. 7*b*, the adhesive may be curable thermally, for example by use of a heated press or common clothing iron, in which case the control fascia material must be heat-resistant to the degree necessary to withstand the temperature of the iron or press. However, a photo curable thermoset adhesive may also be used, or a thermoset adhesive activatable by applying a catalyst or curing agent to the adhesive surface or to the surface of the blade to which the fascia is to be mounted. The fascia may also be supplied without an adhesive film, to be mounted to the stick with a thermosettable liquid adhesive.

The control fascia may also be attached to a hockey stick at the time of manufacture, or the control fascia may be molded onto or into the blade of the stick. The durability of the subject control fascias, unlike tape, makes it possible to manufacture the stick with the fascia mounted thereto. The fascia is capable of lasting for the lifetime of the stick.

The stick may also be manufactured by molding the control fascia into or onto the blade. For example, a prefabricated blade may be inserted into a press containing a thermoplastic film, the press having suitable molds to simultaneously emboss and bond the thermoplastic film to the blade. Alternatively, the blade may itself by made of thermoplastic material, e.g. polypropylene, and embossed in a press, or may be separately formed by injection molding or like processes to have the requisite control fascia surfaces integrally molded with the blade. As a further alternative, the control fascia may be molded onto or adhered to a ply used to form a laminated blade, or may itself be a ply of the laminate to be constructed. In any event, the blade fascia shall have the ridges, valleys, and granularity described previously.

The preferred method of manufacturing the control fascias of the subject invention is to supply a film of molten or softened thermoplastic to a roller having the desired pattern machined into its surface, following which a backing layer, i.e. a layer of nonwoven, is supplied on top of the pattern and adhered to the molten or softened thermoplastic under pressure. Such techniques of manufacture are well known in the art of plastics processing and need not be further detailed. It should be noted that although it is preferred that the ribs of the patterns are elevated from the front fascia surface without a corresponding hollow on the back surface of the fascia element, it is certainly within the scope of the invention to produce control fascias which contain such projections/hollows as well.

The control fascias of the subject invention are useful in both ice hockey and street hockey. In the latter, in particular, when the dimensions of the valleys, ridges, etc. of the subject invention are adhered to, much improved ball control is achieved, both laterally, and in particular with respect to the stick rolling over the ball.

Having now fully described the invention, it will be apparent to one of ordinary skill in the art that many changes and modifications can be made thereto without departing from the spirit or scope of the invention as set forth herein.

What is claimed is:

1. A control fascia adapted to be adhesively adhered to a face of a hockey stick blade, said control fascia comprising:

a blade side and a control side, said control side having a plurality of ridges having a vertical component and having a height $H_r$ of from about 0.010 inch to about 0.075 inch, an average valley width of from about 0.01 inch to about 1.0 inch, and a granularity such that improved control of a scoring piece is obtained thereby, said control fascia supplied as a substantially planar sheet material to be applied to a face of said blade without requiring wrapping around said blade to effect mounting thereto, said substantially planar sheet material terminating at an edge thereof in a lip protruding in a direction away from said control side of said fascia, said lip adapted to cover at least a portion of the bottom surface of said hockey stick blade.

* * * * *